US005976294A

United States Patent [19]

Fagnant et al.

[11] Patent Number: 5,976,294

[45] Date of Patent: Nov. 2, 1999

[54] METHOD OF FORMING ROLLS OF RIBBONS INCLUDING PEELABLE LID SHAPES WITH BENT-BACK LIFT TABS

[75] Inventors: Anthony G. Fagnant, Libertyville; Ralph D. Sagel, Ingleside, both of Ill.

[73] Assignee: Label Makers, Inc., Pleasant Prairie, Wis.

[21] Appl. No.: 09/046,330

[22] Filed: Mar. 23, 1998

[51] Int. Cl.[6] ..... B31C 13/00

[52] U.S. Cl. ..... 156/192; 156/204; 156/227; 156/252; 156/253; 156/256; 156/263; 156/270; 156/267; 215/298; 222/480; 222/565; 220/270; 220/359

[58] Field of Search ..... 156/252, 192, 156/253, 256, 263, 270, 267, 204, 221, 226, 227; 215/298; 222/480, 565; 220/270, 359

[56] References Cited

U.S. PATENT DOCUMENTS

| | | | |
|---|---|---|---|
| 2,776,787 | 1/1957 | Nicol | 222/544 |
| 4,300,969 | 11/1981 | Frydendal | 156/244.11 |
| 4,530,230 | 7/1985 | Monks | 72/363 |
| 4,549,917 | 10/1985 | Jensen, Jr. | 156/108 |
| 4,657,614 | 4/1987 | Andersson | 156/244.11 |
| 5,513,781 | 5/1996 | Ullrich et al. | 222/565 |

*Primary Examiner*—Richard Crispino
*Assistant Examiner*—Linda L. Gray
*Attorney, Agent, or Firm*—Reising, Ethington, Barnes, Kisselle, Learman & McCulloch, P.C.

[57] ABSTRACT

A method of producing rolls of ribbons including printing indica at a plurality of locations on at least one of two webs; applying peelable adhesive at a plurality of locations on at least one of the two webs; bonding the two webs together using the adhesive where the indicia and the adhesive are registered with each other; die cutting only one of the webs after bonding to form a plurality of peelable lid shapes, having lift tabs for each peelable lid shape, on the other web; die cutting the other non-cut web to form a plurality of parallel ribbons of interconnected lid shapes with each one of the interconnected lid shapes associated with one of the peelable lid shapes; bending the lift tabs onto their respective peelable lid shape; and winding each of the ribbons into a roll on a central core.

6 Claims, 4 Drawing Sheets

METHOD OF FORMING ROLLS OF RIBBONS INCLUDING PEELABLE LID SHAPES WITH BENT-BACK LIFT TABS

FIELD OF THE INVENTION

This invention relates generally to printing presses and, more particularly, to in-line presses which are adapted to process rolls of ribbons including spaced apart outer lid shapes having bent-back lift tabs, and being peelably attached to a stream of interconnected inner lid shapes.

BACKGROUND ART

Ullrich et al U.S. Pat. No. 5,513,781 discloses a container closure assembly including a sifter, a peel-away liner, and a screw-on or snap-on closure cap. The method taught by Ullrich et al includes forming individual sifters and applying adhesive thereto, combining the two elements, and then applying the closure cap for transfer to a bottling site.

Nicol U.S. Pat. No. 2,776,787 discloses a can wherein one end has openings formed therein, with an indicia-printed tab secured over the openings by a pressure sensitive adhesive. Prior to securing the individual tabs, each is separated at a weakened line from a continuous strip of tabs.

Jensen, Jr. U.S. Pat. No. 4,549,917 discloses a device for forming laminated layers of paper and transparent film, wherein openings are formed in the paper to form windows in registration with the "window panes" of the transparent film.

Forming multiple-layered laminated materials for packages for foodstuffs are disclosed in Frydendal U.S. Pat. No. 4,300,969 and Andersson U.S. Pat. No. 4,657,614. A foil rolling process for producing dual-layered thin gauge metal foil is disclosed in Monks U.S. Pat. No. 4,530,230.

DISCLOSURE OF THE INVENTION

A general object of the invention is to provide an improved method for manufacturing ribbons of dual-layered lids including peelable lids having folded or bent-back tabs thereon.

Another object of the invention is to provide ribbons from dual bonded-together webs, wherein each ribbon includes outer lids bearing predetermined printed indicia and is adapted to being peelably attached to inner strips of lids, and wherein each outer lid includes a lift tab includes a lift tab which is bent back into contact with the lid.

A still further object of the invention is to provide a continuous, single line method for combining two webs of material, wherein one or both webs are printed with selected indicia in cooperating registration, and the outer web is die cut through to form individual lids peelably secured to inner strips or streams of interconnected lids cut through the inner web in registration with the adjacent peelable lids.

These and other objects and advantages will become more apparent when reference is made to the following drawings and the accompanying description.

BEST MODE FOR CARRYING OUT THE INVENTION

Figure 1A:
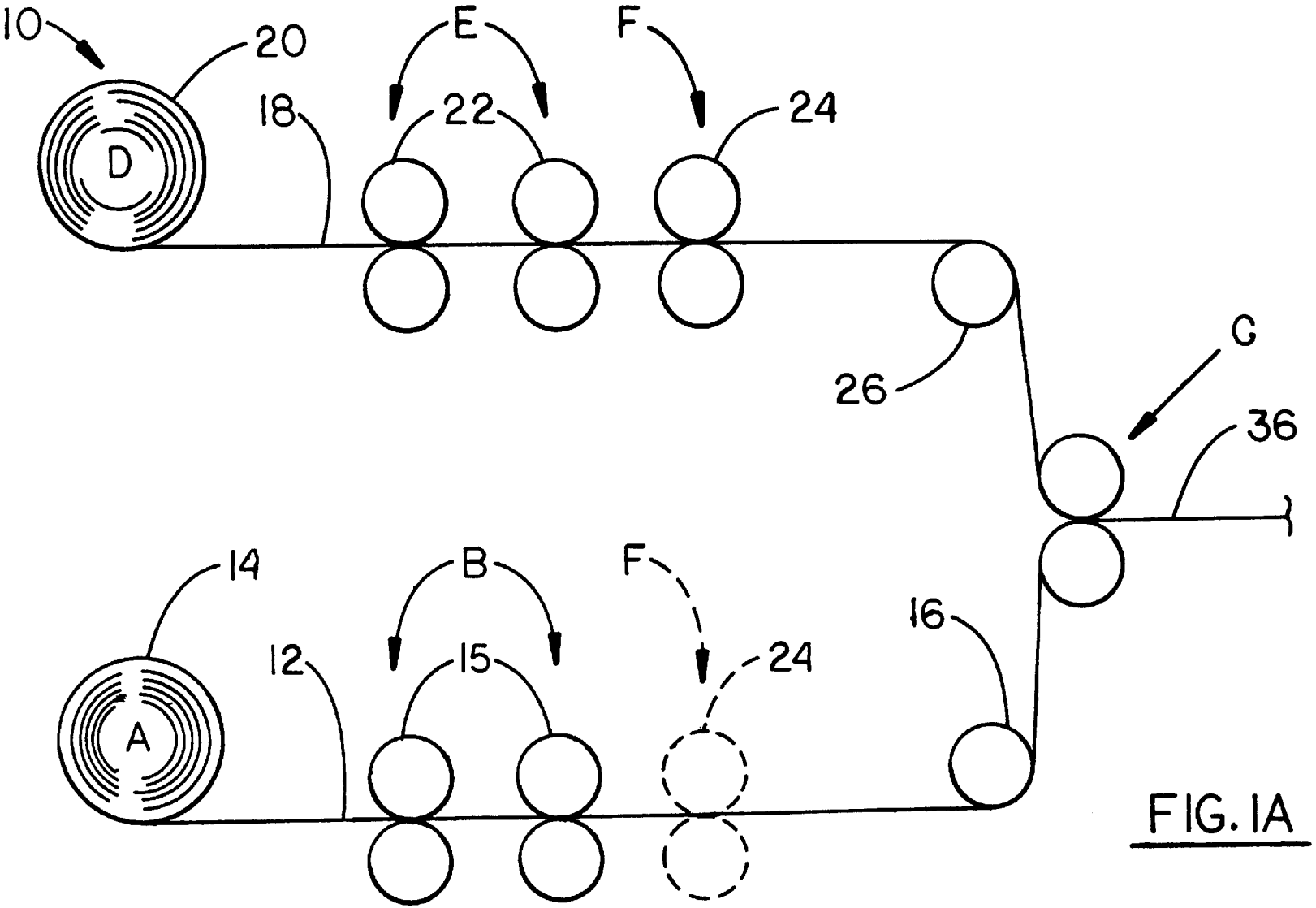
FIGS. 1A, 1B and 1C are side diagramatic views of an in-line printing press embodying some of the progressive steps of the inventive process.
Figure 9:
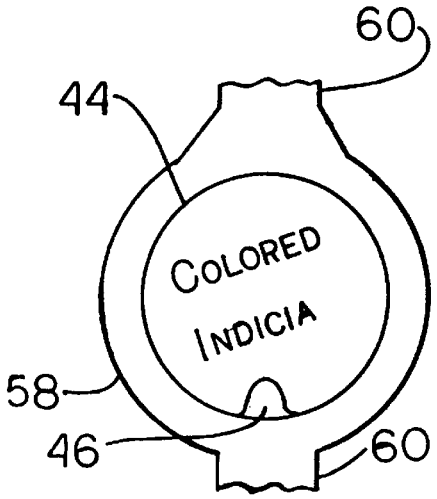

FIG. 1A illustrates a continuous moving, in-line printing press 10 including a first web-loading station A supplying a first web 12 from a roll 14 of selected roll stock to one or more colored ink-applying print stations B, each including a suitable flexographic or other print unit 15, to produce a predetermined printed indicia, and, thence, around an idler roller 16 to a bonding station C. The press 10 includes a second web-loading station D supplying a second web 18 from a second roll 20 of selected roll stock to one or more colored ink-applying print stations E each including a suitable flexographic or other print unit 22, to produce a predetermined printed indicia (FIG. 9), and an adhesive-applying station F including an adhesive printer 24, in a predetermined progressive order, and, thence, around an idler roller 26 to the bonding station C. The printed indicia may occur on one or both sides of the web 18. The adhesive printer 24 prints adhesive in a predetermined pattern on the web as it travels therepast. The pattern may consist of rings or solid circles spaced across the web, in preparation for the bonding station C. If desired, the adhesive printer 24 may be associated with the web 12, as shown in phantom, rather than with the web 18.

After passing the respective idler rollers 26 and 16, at the bonding station C the web 18 becomes peelably bonded to the web 12, to form a dual-layered web 36, with respective printed indicia in registration with one another.

Figure 1B:
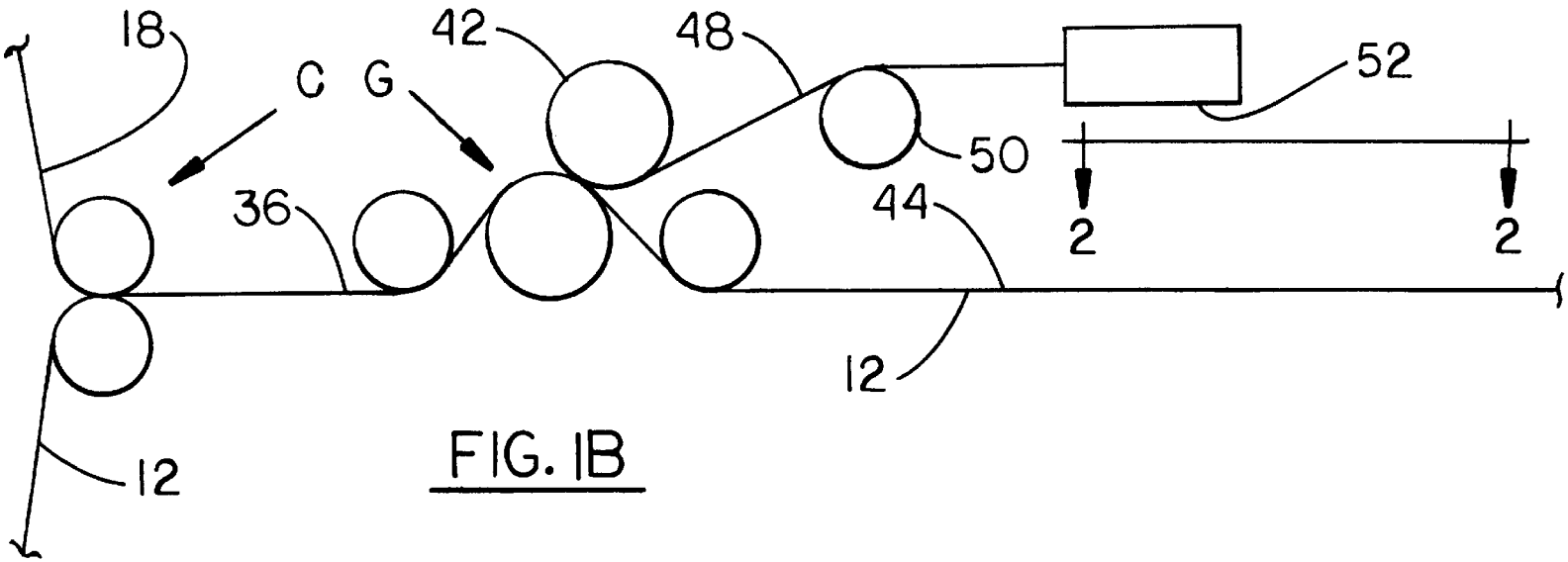
Figure 1C:
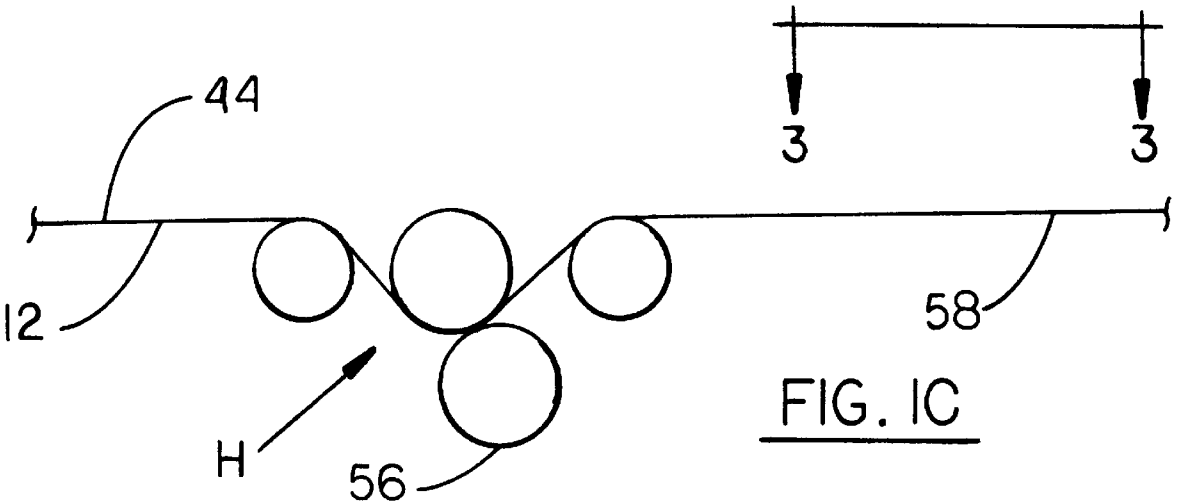
Figure 2:
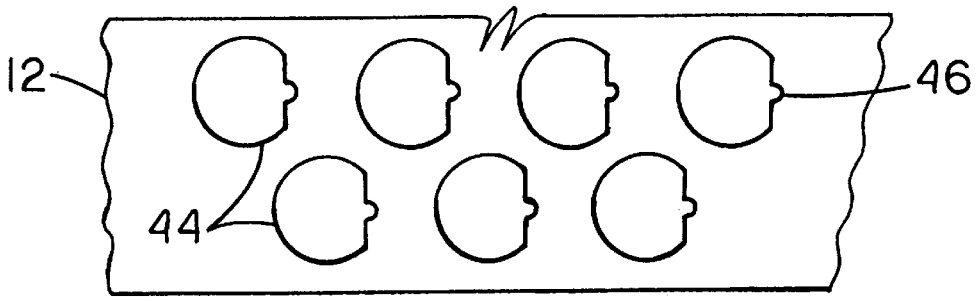
FIG. 2 is a plan view of an end portion of FIG. 1B taken along the plane of the line 2—2 and looking in the direction of the arrows.
Figure 3:
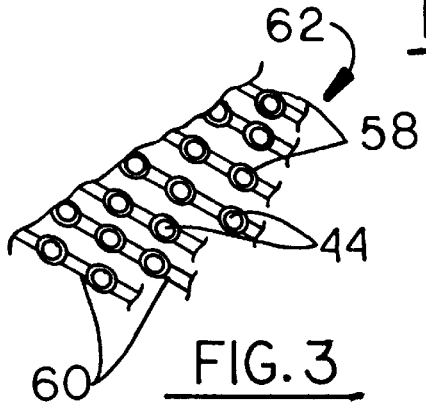
FIG. 3 is a plan view of an end portion of FIG. 1C taken along the plane of the line 3—3 and looking in the direction of the arrows.
Figure 8:
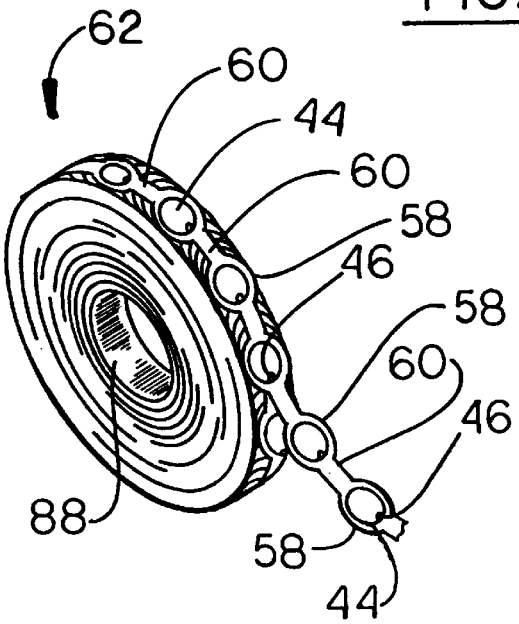
FIG. 8 is enlarged perspective view of the ribbons produced by the FIGS. 1A, 1B, 1C, 2, 3 and 4 process steps; and, FIG. 9 is an enlarged fragmentary view of one of dual-layered lids of the FIG. 8 wound ribbon.

Referring now to FIG. 1B, a second die cut station G follows the bonding station C. At station G, a die cutter 42 cuts through the overlying web 18 of the dual bonded together web 36, to form lateral rows of peelable lid shapes 44 (FIG. 2) around any printed indicia. A lift tab 46 (FIG. 2) is cut to extend beyond the periphery of the adhesive pattern. Waste material 48 of the web 18 between the lid shapes 44 is outside of the adhesive pattern and the tab 46 and, therefor, is not bonded to the underlying perforated web 12. Such waste material is directed upwardly either around a remote roller 50, or over the roller so as to be sucked into a vacuum pickup, including a bailor and vacuum source, represented as 52. The now combined underlying web 12 and overlying lid shapes 44 continues on to a station H (FIG. 1C), to pass through a further die cutter 56 where the underlying web 12 is cut around the overlying peelable lid shapes 44, forming bottom lids 58 while leaving longitudinally extending tabs 60 interconnecting the lids 58 (FIG. 3). As such, the double layers of lids 44 and 58 proceed as ribbons or "daisy-chains" 62, as shown in FIGS. 3 and 8. The waste material between the lid shapes 58 and interconnected tabs 60 is directed upwardly from station H around or over a remote roller (not shown) to be sucked into a further vacuum pickup, including a bailor and vacuum source (not shown).

It should be noted that the web 12 may be formed of any suitable laminate paper or a thermoplastic material, or it may be a sheet coated on the underside thereof with such a material as, say, polyethylene, so that the manufacturer who receives the ribbon roll of underlying interconnected lids and overlying peelable lids, places same on the open top edge of his product container, heats the outermost peripheral edge, around the peelable lid, to bond the perforated lids to the container, now ready for use by an ultimate consumer. The consumer removes the peelable outer lid, which may consist of a coupon, or prize designation, or collectable item. One or both the webs 12 and 18 may, if desired, consist of a foil or other suitable material, with suitable bonding materials added thereto for laminating and/or sealing on the peripheral edge of the final filled container.

Figure 5:
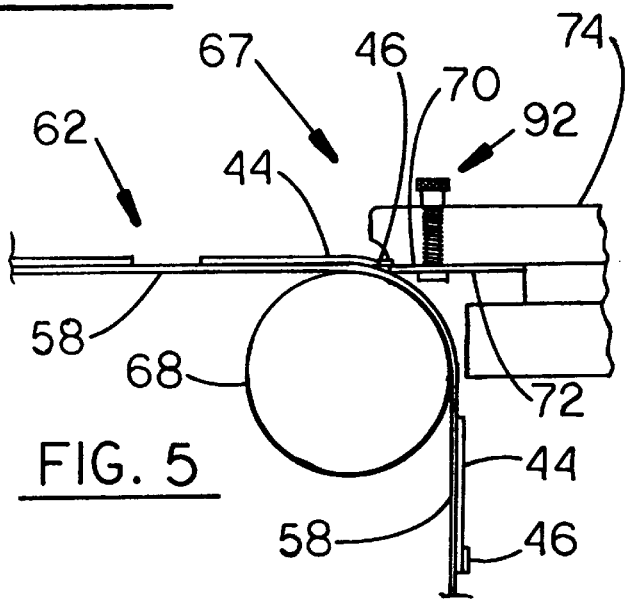
FIG. 5 is an enlarged view of a portion of FIG. 4.
Figures 4, 6, 7:
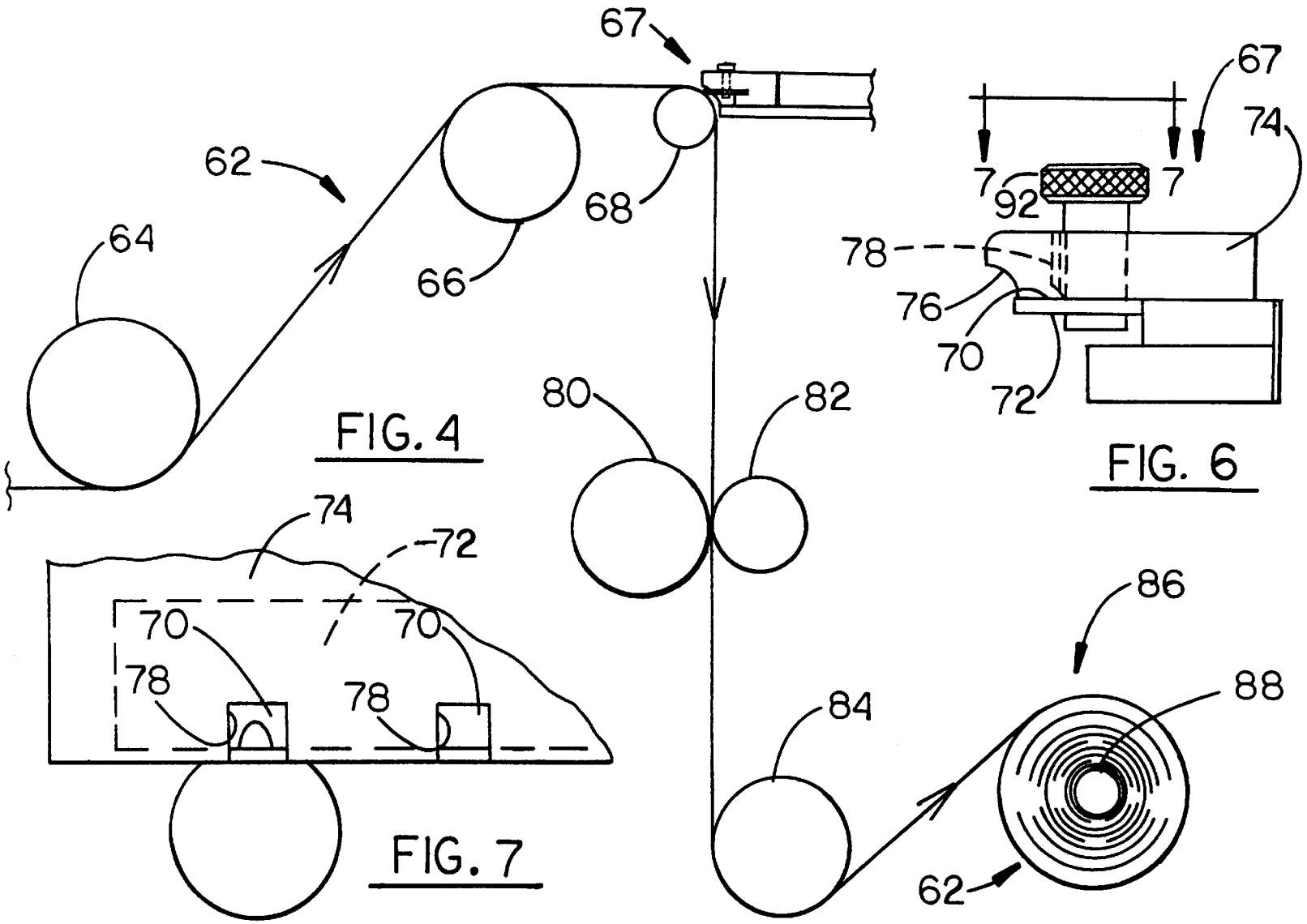
FIG. 4 is a side diagramatic view of a further process step applied to the resultant ribbons shown in FIG. 3.
FIG. 6 is an enlarged detailed view of the tab bending device in FIG. 4 and 5.
FIG. 7 is an enlarged fragmentary view taken along the plane of the line 7—7 of FIG. 6, and looking in the direction of the arrows.

Referring now to FIGS. 4 and 5, it is noted that the ribbons 62 with the bottom lids 58 and overlying peelable lids 44 are directed upwardly around idler rollers 64 and 66, then laterally to a tab bender device 67 to travel over and downwardly from a bend bar 68. As shown in FIG. 5, as each ribbon 62 passes around the bend bar 68, the tab 46 on the lid 44 extends outwardly and over an upper surface 70 of a plate member 72 adjustably secured to the bottom of an upper plate member 74. The latter has a lower arcuate forward surface 76 (FIG. 6) formed thereon to accommodate the arcuate passage thereby of the ribbon 62. The member 74 also includes a plurality of slots 78 (FIG. 7) formed in the its forward edge to permit the entry of the respective tabs 46 so as to engage the surface 70 of the underlying plate member 72. Continuous downward movement of each ribbon 62 causes the tab 46 to bend backwardly into contact with its lid 44.

As shown in FIG. 4, the ribbon 62 with the lid 44 and bent tab 46 proceed between closely adjacent ironing rolls 80 and 82 to flatten the bent-back tabs 46, and thence around a further idler roller 84 to become wound into a roll 86 around a tubular core 88, as better shown in FIG. 8.

An adjustment screw 92 (FIG. 6) through the upper plate member 74 of the tab bender device 67 provides for lateral adjustment of the plate member 72 relative to the depth of the slot 78 to accommodated the entry therein of various tab 46 sizes.

Industrial Applicability

It should be apparent that the invention provides novel and continuous moving, in-line methods for producing improved, practical and readily usable rolls of ribbons consisting of lower interconnected lids and upper peelable lids having bent back lift tabs for the convenience of the ultimate consumer of the contents of a container covered by individual upper and lower bonded-together lids. It's apparent that, while the lower lid is removed to provide access to the container's contents, the upper lid may be peeled therefrom to serve as a coupon, prize designation, a collectible item, or to disclose additional information printed on the bottom lid.

It should be further apparent that the in line press may include a series of alternate upper and lower rollers for feeding either or both webs, and conventional heater and blow drier units in combination with the printing units, serving to dry the respective printed indicia and adhesive patterns during high speed production runs. It's apparent that printing may be applied to one or both sides of the resultant upper lid.

While but one general embodiment of the inventive method has been shown and described, other modifications thereof are possible within the scope of the following claims.

What is claimed is:

1. A method of producing rolls of ribbons, said method comprising the steps of providing at least two individual webs of selected materials to a printing press, performing predetermined operational steps on the webs including printing predetermined indicia on at least one face of at least one of the webs, printing a peelable adhesive on one of the webs, peelably bonding the webs together using the adhesive with the adhesive and indicia in registration with one another, after bonding die cutting one of the webs to form a plurality of selected peelable lid shapes having associated lift tabs for each selected peelable lid shape, on the other web, die cutting the other web to form a plurality of parallel ribbons of interconnected underlying lid shapes with each of the underlying lid shapes associated with one of the peelable lid shapes, bending back the lift tabs onto their respective peelable lid shape, and winding each of the ribbons into a roll on a central core.

2. A method of producing dual-layered rolls of ribbons, said method comprising the following steps:

a. providing a first web from a first roll of selected roll stock;

b. feeding the first web to a first printing station of a printing press, and printing selected indicia at selected locations across the width of the first web;

c. providing a second web from a second roll of selected roll stock;

d. feeding the second web to a printing station of said printing press, and printing selected indicia at selected locations across the width of the second web;

e. applying patterns of peelable adhesive on one of said first and second webs in registration with said indicia thereon;

f. feeding the first web to a bonding station;

g. feeding the second web to the bonding station and bonding the first and second webs together using the adhesive with the second web covering the first web and with said patterns of adhesive in registration with said indicia on the web not applied with the adhesive;

h. feeding the printed bonded-together webs to a first die cut station;

i. die cutting, at the first die station, through the second web only, around the printed indicia thereon to form peelable lids with planar lift tabs;

j. feeding the first web and the overlying peelable lids to a second die cutting station, and die cutting through the first web around the peelable lids to form a plurality of parallel ribbons of interconnected underlying lids with each of the underlying lids associated with one of the peelable lids;

k. removing ribbon waste from around the ribbons;

l. feeding the ribbons to a tab bending station and bending the lift tabs back upon their respective peelable lids; and m. feeding the ribbons with the lift tabs bent back onto and around respective cores.

3. The method described in claim 2, wherein said patterns of adhesive are applied to said first web.

4. The method described in claim 2, wherein said patterns of adhesive are applied to said second web.

5. The method described in claim 2, wherein the printing of selected indicia is selectively on only one side or on both sides of the second web.

6. The method described in claim 2, wherein said tab bending station includes a first plate member having a plurality of slots formed in the forward face thereof, lower arcuate surfaces formed in said forward face intermediate said slots, and an adjustably mounted second plate member mounted on the bottom surface of said first member extending part way beneath said slots adapted to become contacted by respective lift tabs.

* * * * *